US007261016B2

(12) United States Patent
Miller

(10) Patent No.: US 7,261,016 B2
(45) Date of Patent: Aug. 28, 2007

(54) MULTI-FUNCTIONAL SCREWDRIVER

(76) Inventor: Charles H. Miller, 128 N. Lakeview Dr., Lake Helen, FL (US) 32744

( * ) Notice: Subject to any disclaimer, the term of this patent is extended or adjusted under 35 U.S.C. 154(b) by 38 days.

(21) Appl. No.: 10/998,940

(22) Filed: Nov. 30, 2004

(65) Prior Publication Data

US 2006/0112790 A1 Jun. 1, 2006

(51) Int. Cl.
*B25G 3/02* (2006.01)
*B25B 13/00* (2006.01)

(52) U.S. Cl. ..... 81/28; 81/73; 81/35; 81/436; 81/177.1

(58) Field of Classification Search ..... 81/28, 81/73, 35, 177.1, 436, 437
See application file for complete search history.

(56) References Cited

U.S. PATENT DOCUMENTS 470,687 A * 3/1892 Koelzer ..... 81/436
1,642,569 A 9/1927 Winslow et al.
2,712,765 A * 7/1955 Knight, Jr. ..... 81/177.1
5,349,886 A 9/1994 Jin
5,931,065 A * 8/1999 Jackson et al. ..... 81/177.1
6,029,549 A * 2/2000 Baker ..... 81/439
6,668,687 B1 12/2003 Miller

* cited by examiner

*Primary Examiner*—Hadi Shakeri
(74) *Attorney, Agent, or Firm*—Breiner & Breiner, L.L.C.

(57) ABSTRACT

A multi-functional screwdriver including a shaft forming a pair of coplanar bends rotatably mounted to a handle having therein a compartment for storing a plurality of bits is disclosed. To prevent rotation of the shaft within the handle, a locking device is provided which includes a locking member and a collar assembly. The collar assembly includes a lever collar attached to the handle, a locking clamp collar attached to an upper section of the shaft, and an insulator collar for rotatably connecting the lever collar and locking clamp collar. The locking member pivotally attaches to the lever collar and is removably inserted into a depression in the locking clamp collar to prevent the shaft from rotating within the handle.

30 Claims, 1 Drawing Sheet

MULTI-FUNCTIONAL SCREWDRIVER

FIELD OF INVENTION

The invention relates to a multi-functional hand-tool, and more particularly, to a screwdriver for driving fasteners such as screws, bolts and the like. The screw-driver includes an offset shaft having at one end a means of engaging and retaining therein a bit and at an end opposite thereto a handle adapted to rotate relative to the shaft. A locking means pivotally attached to a lever collar on the handle is provided which is arranged to removably engage a locking clamp collar on the shaft to prevent rotation of the handle.

BACKGROUND OF THE INVENTION

When inserting or removing a fastener with a hand tool into or from a work surface, a workman's efficiency is limited by the ability of the tool to translate mechanical force exerted by his hand to the fastener through rotary movement. For example, a tool such as a conventional screw-driver having a fixed handle mounted to a straight shaft imposes a physical limitation on the workman, allowing him to utilize only the torque which he can exert through his hand by the twisting of his wrist. Additionally, because the wrist cannot rotate completely about a circle, to complete a cycle of rotation with a conventional hand tool, the workman must periodically release his grip on the handle of the tool, rotate his hand back to a starting position and re-grip the tool handle to continue applying force.

Attempts have been made to provide rotary tools permitting better translation of the workman's exertions. For example, U.S. Pat. No. 5,349,886 to Jin discloses a hand screwdriver including a freely rotatable handle and a bent shaft having an end recess which selectively bears against one of two conical protrusions within the handle. The conical protrusions provide a fixed position wherein the shaft is fixed to the handle and a rotatable position wherein the shaft is relatively rotated with respect to the handle. The screwdriver further includes a protective coating about the upper portion of the shaft adjacent to the handle for protecting a workman from electrical shock. A shortcoming of Jin is that no means is provided for preventing rotation of the handle relative to the shaft. As such, a workman cannot impart sufficient torque to a fastener when using the screwdriver of Jin to break the fastener loose from a work surface when tightly held therein. Likewise, a workman cannot provide sufficient torque to a fastener to tightly insert it into the work surface. A further shortcoming of Jin is that the protective coating about the shaft fails to envelop the entire shaft thereby needlessly exposing a workman to electrical shock from the unprotected portions of the shaft.

U.S. Pat. No. 1,642,569 to Winslow et al discloses a hand tool including a bent shaft having a handle rotatably attached to an end thereof. Contrary to Jin, a pressure plate is slidably mounted within the handle which slips through a slot therein and is bearable against the handle, selectively fixing the handle to the shaft. This way, a workman can impart increased torque to a fastener than if the handle and shaft were not fixable together. The screwdriver of Winslow et al however provides no suitable means of disengaging the pressure plate from the shaft. For example, a workman attempting to grip the pressure plate while wearing gloves to pull the plate out of the slot will have great difficulty doing so.

Despite the above teachings of the prior art, a need still existed for a hand-powered tool which facilitates the translation of rotary motion from a workman's hand to a fastener through a freely rotating angled shaft while providing practical means of preventing rotation of the shaft when needed. Based thereon, I developed a novel combination of hand-tool accessories with the multi-functional screwdriver as disclosed and claimed in my U.S. Pat. No. 6,668,687 B1 for Multi-Functional Screwdriver. The invention in my patent provides significant advantages over the prior art. However, while an improvement, further improvement has been made to my invention and an improved multi-functional screwdriver is disclosed herein providing further advantages to the workman.

SUMMARY AND OBJECTS OF THE INVENTION

It is a primary object of the invention to provide a multi-functional screwdriver having an offset shaft rotatably connected to a handle wherein the shaft can be releaseably fixed to the handle to prevent rotation of the shaft relative to the handle.

It is a further primary object of the invention to provide a multi-functional screwdriver including an offset shaft rotatably mounted to a handle wherein the shaft can be releaseably fixed to the handle to prevent rotation of the shaft relative to the handle and wherein the shaft is covered in its entirety with a non-conductive material.

It is a further primary object of the invention to provide a multi-functional screwdriver including an offset shaft rotatably mounted to a handle wherein the shaft can be releaseably fixed to the handle to prevent rotation of the shaft relative to the handle and wherein the shaft is magnetic.

It is a further primary object of the invention to provide a multi-functional screwdriver including an offset shaft rotatably mounted to a handle wherein the shaft can be releaseably fixed to the handle to prevent rotation of the shaft relative to the handle and wherein the handle includes a compartment for storing a plurality of bits.

It is a further primary object of the invention to provide a multi-functional screwdriver having an offset magnetic shaft covered in its entirety by a non-conductive sleeve, the shaft being rotatably mounted to a handle wherein a locking member is pivotally attached to a lever collar of a collar assembly on the handle and which is releaseably engageable with a locking clamp collar of the collar assembly on the shaft to prevent rotation of the handle relative to the shaft and wherein the handle includes a compartment for storing a plurality of bits.

It is a further primary object of the invention to provide a multi-functional screwdriver having an offset shaft rotatably mounted to a handle wherein a collar assembly is releaseably engageable with the handle and the shaft to aid in releaseably mounting the shaft to the handle and engaging a locking member and wherein the locking member is pivotally attached to a lever collar of the collar assembly on the handle and wherein the locking member is releaseably engageable with a locking clamp collar of the collar assembly on the shaft to prevent rotation of the handle relative to the shaft.

The screwdriver of the present invention comprises an offset shaft having two co-planer bends therein thus providing the shaft with a relaxed Z-shape; a handle having a resealable compartment for storing a plurality of bits, the handle being rotatably mounted to the shaft; a non-conductive sleeve circumposed about an entire length of the shaft; a magnetic bit driver connected at an end of the shaft opposite the handle; and a means of locking the shaft to the handle to prevent rotation of the handle relative to the shaft.

More particularly, the locking means of the invention includes a collar assembly fixed to the handle and the shaft and an elongated, taper-end locking member connected to the collar assembly by a pin or hinge so that the locking member and collar assembly form a lever and fulcrum, respectively. The collar assembly of the invention includes a lever collar attached to the handle, a locking clamp collar attached to the shaft and an insulator collar for rotatably connecting together the lever collar and the locking clamp collar. An opening, hole or groove in the locking clamp collar which is adapted to receive an end of the locking member is provided which allows the workman to fix or unfix the shaft to the handle by pivoting the locking member either toward the locking clamp collar of the collar assembly on the shaft to prevent rotation of the handle relative to the shaft or toward the handle to allow the rotation of the handle relative to the shaft.

Preferably, the locking means includes the locking member as described above pivotable on a pin located within a depression within the lever collar. The depression conforms to the shape of the locking member. A depression may also be located within the handle operatively near the lever collar which is long enough to accept the entire portion of the locking member that is adjacent to the handle when the locking member is pressed there against. The depression in the handle includes means of snapping or securing the locking member therein when the locking member is not engaged with the locking clamp collar on the shaft. This way, the locking member, in part, can be securely held within the handle when the handle and shaft are in an unlocked position. Snapping means can include, for example, a ball and detent system, a spring or simply a portion of the depression having decreased width which allows the locking member to fit snugly therein.

Though it is preferred that the locking member comprises a substantially elongated, taper-end shape, it is anticipated that various modifications of the locking member can be made. For example, the locking member can include a rectangular member having rounded edges which conform the shape of the locking member to the handle and/or shaft to provide a more ergonomic design. The locking means therefore may be any fulcrum and lever system that allows the lever to engage the locking clamp collar attached to the shaft, for example, at the opening or groove in the locking clamp collar, thereby fixing the shaft to the handle.

These primary and other objects of the invention will be apparent from the following description of a preferred embodiment of the invention and from the accompanying drawings.

BRIEF DESCRIPTION OF THE DRAWINGS

Referring now to the drawings.

DETAILED DESCRIPTION OF THE PREFERRED EMBODIMENTS

Figures 1, 2, 3, 4:
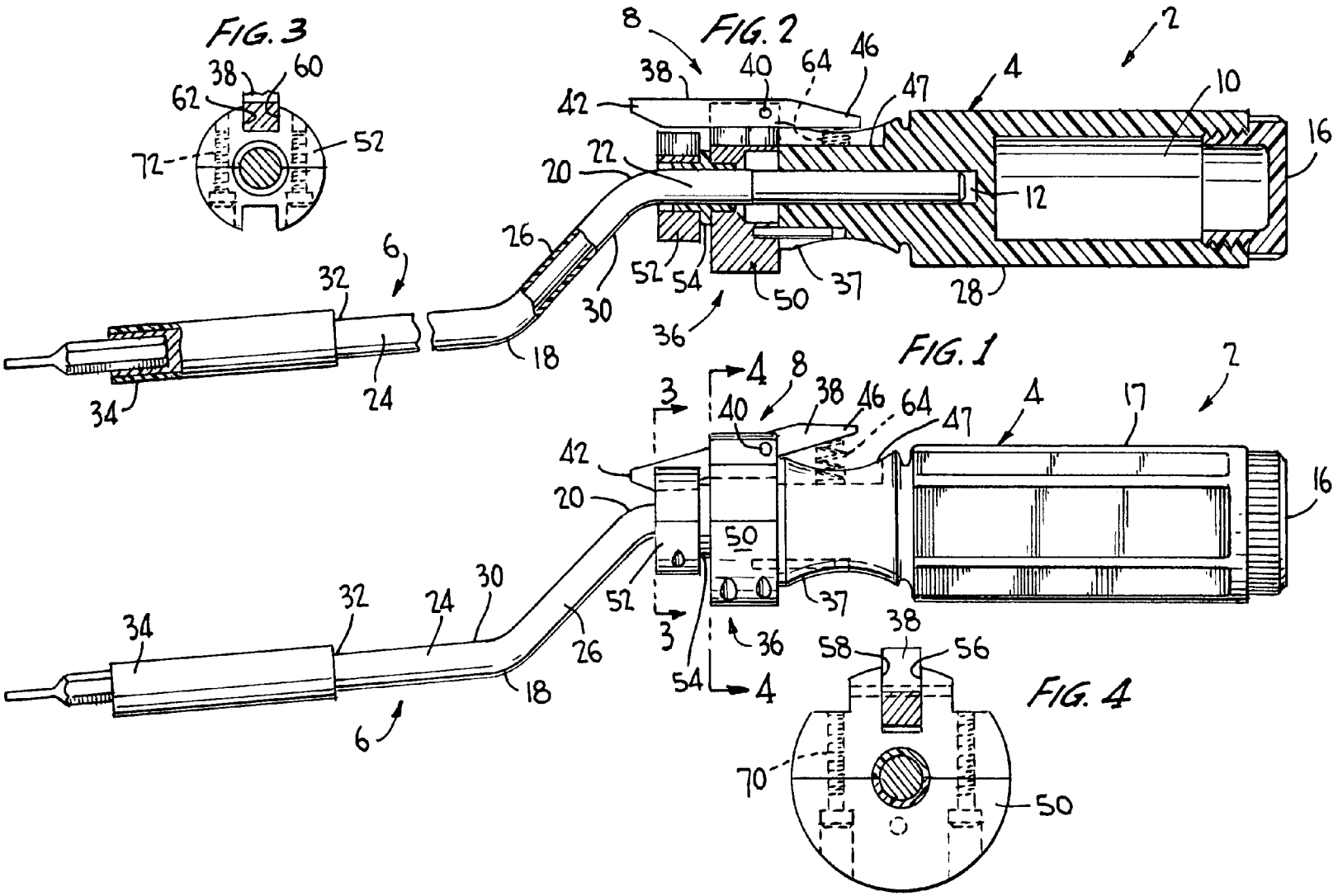
FIG. 1 shows a side plan view of a multi-functional screwdriver in a locked position in accordance with a preferred embodiment of the present invention.
FIG. 2 shows a side partially cross-sectional view of the multi-functional screwdriver of FIG. 1 in an unlocked position.
FIG. 3 shows a cross-sectional front view of the multi-functional screwdriver taken along the line 3-3 of FIG. 1.
FIG. 4 shows a cross-sectional front view of the multi-functional screwdriver taken along the line 4-4 of FIG. 1.

A preferred embodiment of an improved multi-functional screwdriver 2 and parts thereof for inserting fasteners such as screws and bolts into a workpiece are illustrated in FIGS. 1-4. The screwdriver 2 generally includes a handle 4, an offset or bent shaft 6 rotatably mounted to handle 4 and a locking means 8 pivotally attached to handle 4 and shaft 6 for effectively preventing rotation of handle 4 about shaft 6.

Handle 4 is an essentially cylindrical shaped member constructed of any suitable material such as high-impact plastic or wood. A pair of open-ended, opposing compartments 10 and 12 are formed within handle 4 for providing a location for storage of a plurality of bits (not shown) and for rotatably engaging shaft 6, respectively. A lid 16 is provided to resealably enclose compartment 10 containing the bits. To allow a worker to better hold the screw-driver a grip 17 is included about handle 4.

As illustrated in FIGS. 1 and 2, shaft 6 forms a pair of coplanar bends 18 and 20 which give shaft 6 a relaxed Z-shape making shaft 6 offset relative to handle 4. This way, shaft 6 when engaged with a fastener can be rotated within handle 4 to, in turn, rotate the fastener. Bends 18 and 20 define three distinct sections of shaft 6, namely an upper section 22, a lower section 24 and a middle section 26. Upper section 22 of shaft 6 is rotatably mounted within compartment 12 of handle 4. A rotating means 28 allows for rotation of shaft 6 within handle 4 and can be any suitable means known in the art, for example, as disclosed in U.S. Pat. No. 5,706,709 to Snow, U.S. Pat. No. 1,642,569 to Winslow et al or U.S. Pat. No. 4,974,477 to Anderson. Positioned at an end 32 of lower section 24, a bit driver 34 is provided for retaining one of the plurality of bits. Bit driver 34 is preferably magnetic and attached at end 32 by welding and the like or a ball and detent mechanism so that bit driver 34 is interchangeable. Shaft 6 is constructed of any suitable metal, preferably, a metal capable of being magnetized so that the bits and/or fasteners are held thereagainst for easy loading of shaft 6.

To protect a workman from electrical shock when using the present invention, shaft 6 is covered throughout its length with a sleeve 30 constructed of any durable non-conductive material or composite. Sleeve 30 may cover only a portion of shaft 6, for example, upper section 22, but doing so exposes a workman to an easily preventable risk. Suitable materials for sleeve 30 include, for example, plastic, rubber and woven or non-woven cloth and should have a strength and thickness to prevent punctures or tears of sleeve 30.

As illustrated in FIGS. 1-4, locking means 8 of the embodiment therein includes a collar assembly 36 mounted onto handle 4 at an end 37 opposite compartment 10. Collar assembly 36 includes a lever collar 50 attached to handle 4, a locking clamp collar 52 attached to upper section 22 of shaft 6 and an insulator collar 54 for rotatably connecting together lever collar 50 and locking clamp collar 52. Lever collar 50 has a depression in a top portion thereof creating a pair of opposing, substantially parallel faces 56,58 and provides a support on which an elongated locking member 38 can be pivotally mounted thereto by a pin 40, or other means, which extends through locking member 38 and the parallel faces 56,58 of lever collar 50 of collar assembly 36. This way, lever collar 50 of collar assembly 36, in conjunction with pin 40, serve as a fulcrum and locking member 38 serves as a lever which pivots on pin 40. Additionally, locking clamp collar 52 has a depression in a top portion thereof creating a pair of opposing, substantially parallel faces 60,62.

A first securing means 70, such as screws, bolts, fasteners, adhesive, or the like, may be used to attach lever collar 50 to handle 4. A second securing means 72, such as screws, bolts, fasteners, adhesive, or the like, may be used to attach locking clamp collar 52 to upper section 22 of shaft 6. In a preferred embodiment, first securing means 70 and second securing means 72 are screws, as shown in FIGS. 3 and 4.

Locking member 38 includes a first portion 42 which extends from the intersection of pin 40 with locking member 38 out over collar assembly 36 which is adjacent to upper section 22 of shaft 6. As illustrated in FIG. 1, first portion 42 of locking member 38 is adapted to be pivoted downward when pressure is applied thereagainst by the hand of a workman to insert first portion 42 of locking member 38 into the depression of locking clamp collar 52. When first portion 42 of locking member 38 is actuated into the depression of locking clamp collar 52, shaft 6 cannot be rotated within compartment 12 of handle 4. As such, a workman can impart torque to shaft 6, as if shaft 6 and handle 4 where integral, in a greater amount than if handle 4 and shaft 6 were rotatable relative to one another.

Opposite first portion 42 of locking member 38 is a second portion 46 which extends from the intersection of locking member 38 with pin 40 out over and adjacent to handle 4. Second portion 46 is adapted to receive pressure from the hand of a workman to pivot portion 46 toward and ultimately against handle 4 in order to disengage first portion 42 from the depression of locking clamp collar 52 of collar assembly 36. In this unlocked position, as illustrated in FIG. 2, shaft 6 is allowed to rotate within compartment 12 of handle 4 to allow a workman to more quickly and efficiently insert or remove a fastener than if handle 4 and shaft 6 were not rotatable relative to one another.

Handle 4 may have a depression 47 which conforms in shape and width to second portion 46 of locking member 38. Accordingly, locking member 38 may pivot within the depression 47 on pin 40 as described above. An advantage of depression 47 is that means can be employed in combination with depression 47 for securely retaining within depression 47 second portion 46 of locking member 38. Suitable means include, for example, a ball and detent system or a narrowed portion within depression 47 which is not as wide as second portion 46 of locking member 38 so that second portion 46 will fit snugly therein.

In an alternative embodiment, a spring 64 (shown in phantom lines) may be positioned within depression 47 and attached to a bottom side of second portion 46 of locking member 38. Spring 64 may be used to engage locking member 38 automatically in the un-locked position or in the locked position in locking clamp collar 52 of collar assembly 36.

Multi-functional screwdriver 2 of the present invention is used in the manner of conventional rotary hand tools to exert torque to a fastener. To use screwdriver 2, a workman selects and inserts one of the plurality of bits into bit driver 34 where it is held in place by magnetic force. The bit is used to engage a fastener about which shaft 6 is rotated by applying rotary motion to handle 4. The offset of handle 4 allows the workman to use a cranking motion of his entire arm rather than of just his wrist, better utilizing the muscles of his shoulder and back as well as those of the upper arm.

When the fastener is nearly completely inserted into a work surface and tightening of the fastener desired, locking means 8 allows the workman to simply apply pressure to first portion 42 of locking member 38 so that it enters the depression formed in locking clamp collar 52 of collar assembly 36 to prevent rotation of shaft 6. To disengage first portion 42 from the depression of locking clamp collar 52, the workman simply applies pressure to second portion 46.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A multi-functional hand tool comprising:

a handle;

a shaft rotatably mounted to said handle; and a locking device comprising a collar assembly and a locking member pivotally attached to said handle and said shaft, wherein said locking member being adapted to be removably engaged with said shaft to effectively prevent rotation of said handle relative to said shaft, wherein said collar assembly comprises:

a lever collar attached to said handle;

a locking clamp collar attached to said shaft; and an insulator collar rotatably connecting together said lever collar and said locking clamp collar.

2. The hand tool according to claim 1, wherein said lever collar has a depression in a top portion thereof thereby creating a pair of opposing, substantially parallel faces, and wherein said locking clamp collar has a depression in a top portion thereof thereby creating a pair of opposing, substantially parallel faces.

3. The hand tool according to claim 2, wherein said locking member engages said depression in said locking clamp collar.

4. The hand tool according to claim 2, wherein said locking member is pivotally attached to said pair of opposing, substantially parallel faces of said lever collar by a pin.

5. The hand tool according to claim 4, wherein said locking member engages said depression in said locking clamp collar.

6. The hand tool according to claim 1, wherein said locking member engages a depression in said locking clamp collar.

7. The hand tool according to claim 1, wherein said locking member is pivotally attached to said lever collar by a pin.

8. A multi-functional hand tool comprising:

a handle;

a shaft rotatably mounted to said handle; and a locking device comprising a collar assembly and a locking member pivotally attached to said handle and said shaft, wherein said locking member being adapted to be removably engaged with said shaft to effectively prevent rotation of said handle relative to said shaft, wherein said shaft forms a pair of coplanar bends, said pair of bends defining an upper section of said shaft, a lower section of said shaft and a middle section of said shaft, wherein said upper section of said shaft is rotatably mounted to said handle, wherein said collar assembly comprises:

a lever collar attached to said handle;

a locking clamp collar attached to said upper section of said shaft; and an insulator collar rotatably connecting together said lever collar and said locking clamp collar.

9. The hand tool according to claim 8, wherein said lever collar has a depression in a top portion thereof thereby creating a pair of opposing, substantially parallel faces, and wherein said locking clamp collar has a depression in a top portion thereof thereby creating a pair of opposing, substantially parallel faces.

10. The hand tool according to claim 9, wherein said locking member engages said depression in said locking clamp collar.

11. The hand tool according to claim 9, wherein said locking member is pivotally attached to said pair of opposing, substantially parallel faces of said lever collar by a pin.

12. The hand tool according to claim 11, wherein said locking member engages said depression in said locking clamp collar.

13. The hand tool according to claim 8, wherein said locking member engages a depression in said locking clamp collar.

14. The hand tool according to claim 8, wherein said locking member is pivotally attached to said lever collar by a pin.

15. A multi-functional hand tool comprising:

a handle having a compartment therein for storing a plurality of bits;

a shaft rotatably mounted to said handle;

a non-conductive sleeve circumposed about said shaft;

a bit driver mounted to a lower section of said shaft; and a locking device comprising a collar assembly and a locking member pivotally attached to said handle and said shaft, wherein said locking member being adapted to be removably engaged with said collar assembly to effectively prevent rotation of said handle relative to said shaft, wherein said collar assembly comprises:

a lever collar attached to said handle;

a locking clamp collar attached to said shaft; and an insulator collar rotatably connecting together said lever collar and said locking clamp collar.

16. The hand tool according to claim 15, wherein said lever collar has a depression in a top portion thereof thereby creating a pair of opposing, substantially parallel faces, and wherein said locking clamp collar has a depression in a top portion thereof thereby creating a pair of opposing, substantially parallel faces.

17. The hand tool according to claim 16, wherein said locking member engages said depression in said locking clamp collar.

18. The hand tool according to claim 16, wherein said locking member is pivotally attached to said pair of opposing, substantially parallel faces of said lever collar by a pin.

19. The hand tool according to claim 18, wherein said locking member engages said depression in said locking clamp collar.

20. The hand tool according to claim 15, wherein said locking member engages a depression in said locking clamp collar.

21. The hand tool according to claim 15, wherein said locking member is pivotally attached to said lever collar by a pin.

22. A multi-functional hand tool comprising:

a handle having a compartment therein for storing a plurality of bits;

a shaft rotatably mounted to said handle;

a non-conductive sleeve circumposed about said shaft;

a bit driver mounted to a lower section of said shaft; and a locking device comprising a collar assembly and a locking member pivotally attached to said handle and said shaft, wherein said locking member being adapted to be removably engaged with said collar assembly to effectively prevent rotation of said handle relative to said shaft, wherein said shaft forms a pair of coplanar bends, said pair of bends defining an upper section of said shaft, a lower section of said shaft and a middle section of said shaft, wherein said upper section of said shaft is rotatably mounted to said handle, wherein said collar assembly comprises:

a lever collar attached to said handle;

a locking clamp collar attached to said upper section of said shaft; and an insulator collar rotatably connecting together said lever collar and said locking clamp collar.

23. A multi-functional hand tool comprising:

a handle having a resealable compartment therein for storing a plurality of bits;

a magnetic shaft rotatably mounted to said handle;

a non-conductive sleeve circumposed about an entire exposed length of said shaft;

a magnetic bit driver mounted to a lower section of said shaft; and a locking device comprising a collar assembly and a locking member pivotally attached to said handle and said shaft, wherein said locking member being adapted to be removably engaged with said collar assembly to effectively prevent rotation of said handle relative to said shaft, wherein said collar assembly comprises:

a lever collar attached to said handle;

a locking clamp collar attached to said shaft; and an insulator collar rotatably connecting together said lever collar and said locking clamp collar.

24. The hand tool according to claim 23, wherein said lever collar has a depression in a top portion thereof thereby creating a pair of opposing, substantially parallel faces, and wherein said locking clamp collar has a depression in a top portion thereof thereby creating a pair of opposing, substantially parallel faces.

25. The hand tool according to claim 24, wherein said locking member engages said depression in said locking clamp collar.

26. The hand tool according to claim 24, wherein said locking member is pivotally attached to said pair of opposing, substantially parallel faces of said lever collar by a pin.

27. The hand tool according to claim 26, wherein said locking member engages said depression in said locking clamp collar.

28. The hand tool according to claim 23, wherein said locking member engages a depression in said locking clamp collar.

29. The hand tool according to claim 23, wherein said locking member is pivotally attached to said lever collar by a pin.

30. A multi-functional hand tool comprising:

a handle having a resealable compartment therein for storing a plurality of bits;

a magnetic shaft rotatably mounted to said handle;

a non-conductive sleeve circumposed about an entire exposed length of said shaft;

a magnetic bit driver mounted to a lower section of said shaft; and a locking device comprising a collar assembly and a locking member pivotally attached to said handle and said shaft, wherein said locking member being adapted to be removably engaged with said collar assembly to effectively prevent rotation of said handle relative to said shaft, wherein said shaft forms a pair of coplanar bends such that said shaft has a relaxed Z-shape, said pair of bends defining an upper section of said shaft, a lower section of said shaft and a middle section of said shaft, wherein said upper section of said shaft is rotatably mounted to said handle, wherein said collar assembly comprises:

a lever collar attached to said handle;

a locking clamp collar attached to said upper section of said shaft; and an insulator collar rotatably connecting together said lever collar and said locking clamp collar.

* * * * *